US005206449A

United States Patent [19]

McClish

[11] Patent Number: 5,206,449

[45] Date of Patent: Apr. 27, 1993

[54] OMNIPLANAR PICKUP FOR MUSICAL INSTRUMENTS

[76] Inventor: Richard E. D. McClish, 1739 Addison Suite 15, Berkeley, Calif. 94703

[21] Appl. No.: 505,213

[22] Filed: Dec. 14, 1989

Related U.S. Application Data

[63] Continuation of Ser. No. 218,950, Jul. 14, 1988, abandoned.

[51] Int. Cl.[5] ..... G10H 3/00

[52] U.S. Cl. ..... 84/723; 84/724; 84/726; 84/730; 84/731

[58] Field of Search ..... 84/723, 724, 725, 726, 84/730, 731, 734, 735, 743

[56] References Cited

U.S. PATENT DOCUMENTS

| | | | |
|---|---|---|---|
| 3,453,920 | 7/1969 | Scherer | 84/DIG. 24 |
| 4,248,120 | 2/1981 | Dickson | 84/1.16 |
| 4,348,930 | 9/1982 | Chobanian et al. | 84/1.15 |
| 4,480,520 | 11/1984 | Gold | 84/1.15 X |
| 4,534,258 | 8/1985 | Anderson | 84/1.15 |
| 4,730,530 | 3/1988 | Bonanno | 84/1.16 |
| 4,884,486 | 12/1989 | McClish | 84/736 |
| 4,903,566 | 2/1990 | McClish | 84/734 |
| 4,911,054 | 3/1990 | McClish | 84/725 |
| 4,916,350 | 4/1990 | Madden et al. | 84/DIG. 24 |

FOREIGN PATENT DOCUMENTS

| | | | |
|---|---|---|---|
| 3528991 | 2/1987 | Fed. Rep. of Germany | 84/1.16 |

*Primary Examiner*—A. T. Grimley
*Assistant Examiner*—Matthew S. Smith

[57] ABSTRACT

A pickup responsive in all planes of vibration of a vibrating element of a musical instrument uses two transducers, each maximally responsive in a different plane of vibration. The transducer signals are dephased with respect to each other in order to reduce and possibly eliminate the additive and substractive tendencies of the common portion of the signals when they are combined to produce the pickup signal. The signals may be dephased using a phase shifting network or device, or by using different types of transducers (i.e.: position-sensing for the first transducer and velocity-sensing for the second transducer) which produce signals which are already dephased and thus only require to be combined in order to produce the claimed response.

9 Claims, 5 Drawing Sheets

OMNIPLANAR PICKUP FOR MUSICAL INSTRUMENTS

CROSS REFERENCE TO OTHER APPLICATIONS

This application is a continuation of U.S. application Ser. No. 07/218,950 filed on Jul. 14, 1988 and which is now abandoned.

BACKGROUND ART

Transducers of many kinds are commonly used in connection with musical instruments in order to allow them to be amplified, recorded or to remotely control a second instrument.

Many musical instruments have one or more vibrating elements such as a reed, a membrane or a string. Reeds and membranes generally vibrate in a fixed plane of vibration but vibrating strings and other rod-like vibrating elements usually vibrate in different planes. The string of a bowed instrument characteristically vibrates in a plane parallel to the surface of the bow. The string of a plucked instrument will start vibrating in a plane parallel to the direction of plucking but will change its plane of vibration. Characteristically, the plane of vibration of the string of a plucked or hammered instrument will constantly change and if it is permitted to vibrate long enough without being damped or replayed, the string will vibrate in constantly changing planes through 360 degrees.

Pickups of the prior art typically produce a signal, the strength of which is proportional to the vector of the plane of vibration of the vibrating element in the direction of maximum sensitivity of the pickup. To attain natural reproduction of the sound produced by a vibrating element of a musical instrument, the amplitude of the pickup signal should be the same for a given amplitude of vibration, irrespectively of the plane of vibration of the vibrating element. Virtually all contact and proximity transducers of the prior art have heretofore exhibited a significantly different response to the vibrations of a vibrating element in various planes of vibration.

U.S. Pat. No. 3,301,936 issued to Carman et al describes a mechanico-electrical pickup for an instrument string having maximum sensitivity in the direction of the axis of the string. Such a pickup responds to changes in the tension of the string and although it responds equally in all planes of vibration, the signal produced in response to a simple vibration of the string will be an octave above the frequency of this simple vibration. This occurs because changes in the tension of the string occur at twice the rate of the string vibration.

Such frequency doubling tends to give the pickup a thin sound and is not desirable from a musical standpoint. It is generally agreed to in the prior art that a pickup should accurately transduce the fundamental frequency of the monitored vibrations in order to produce a natural sounding tone signal.

A first problem exists when using pickups of the prior art in a stringed instrument such as a bass guitar, that "dead notes" are sometimes encountered because the pickups fail to respond in the plane in which the fundamental frequency of the remanent string vibrations has settled shortly after the attack of a played note. A second problem exists with virtually any pickup of the prior art, that the direction of excitation of the string influences the sound of the attack of the note to a high degree. A third problem exists when detecting the fundamental frequency of the played note using pickups of the prior art for the purpose of controlling a second instrument such as a music synthesizer, that these pickups tend to produce either a very reduced amplitude or a frequency doubling effect in response to string vibrations in certain planes, which makes the detection significantly more difficult if not impossible to perform in these instances.

It is therefore a broad object of the present invention to provide a pickup for a stringed instrument which responds approximately equally in all planes of vibration of a vibrating element.

It is a more specific object of the present invention to provide a pickup which accurately transduces the frequencies of vibration of the vibrating element, irrespectively of the plane of such vibrations.

It is a further object of the present invention to provide a pickup for an instrument string which is approximately equally responsive in all directions of excitation of the vibrating element.

It is a still further object of the present invention to provide a pickup which produces a strong fundamental frequency corresponding to that of the vibrations of the vibrating element.

SUMMARY OF THE INVENTION

This invention is a pickup for a musical instrument that transduces the vibrations of a vibrating element to strong signals that are characteristic of those vibrations both in amplitude and in frequency in all planes of vibration. The pickup of this invention minimally employs two transducers positioned and oriented in a manner to be maximally responsive in different planes of vibration of the monitored vibrating element. The individual transducer signals are phase shifted with respect to each other to prevent cancellations which would otherwise occur between the two signals when they are of equal magnitude and of opposite polarity as a result of certain modes of vibration of the monitored vibrating element. The phase shifted transducer signals are combined to produce a joint signal. The joint signal is the pickup signal. When the transducers of the pickup respond maximally in perpendicular planes of vibration of the vibrating element while the phase difference between the two combined transducer signals is effectively equal to about 90 degrees, the pickup has equal sensitivity in all planes of vibration of the monitored vibrating element. A pickup according to the present invention may monitor a plurality of vibrating elements.

To provide a phase difference between the two transducer signals of the pickup, a "constant phase shift" network is preferred. This type of network is well known to persons of ordinary skill in the art filter design; it usually consists of a pair of all-pass filters having different turnover frequencies. Although about 90 degrees of phase shift between the two transducer signals is preferable from the standpoint of omniplanar performance, any degree of phase shift other than 0 degrees, 180 degrees and all integer multiples thereof between the two transducer signals will tend to reduce the substractive and additive effects between the two combined transducer signals to a certain degree. Although it is preferable for the phase shift network to have constant phase shift over the entire audio range, the present invention requires only that a phase shift exist at the fundamental frequency of vibration of the vibrating element.

This is musically acceptable since harmonics usually evolve over time in a different manner than the corresponding fundamental frequency of vibration during a played note.

In a first embodiment, a pickup according to the present invention has two pressure transducer elements located under a string receiving element which supports a contacting string. The transducer elements produce separate signals which are passed through a constant phase shift network in order to dephase the signals by a constant 90 degrees over the entire frequency range of the string vibrations. The dephased signals are resistively summed to produce a joint signal.

In a second embodiment, a pickup according to the present invention has a pair of coils positioned transversely under a plurality of strings. A number of staggered magnetic polepieces are placed alternately in the coils. The coils respond in different planes of vibration of each string and produce composite string signals when a plurality of strings are played. The signals from the coils are passed through a phase shift network and the phase shifted signals are summed to produce the pickup signal.

In a third embodiment, the signal from a pressure transducer maximally responsive in a first plane of vibration of a vibrating string is mixed with the signal from a magnetic pickup maximally responsive in a second plane of vibration of the string. A phase difference exists between the two signals as a result of using transducers of different types responsive to different qualities of the string movements.

In a fourth embodiment, a vibrating string is located between a single light-sensitive element and a pair of light sources respectively positioned and oriented in a manner to render the light-sensitive element responsive to a first plane of string vibration when the first light source is powered and responsive in a second plane of string vibration when the second light source is powered. The light sources are alternately powered at a fast rate, causing two multiplexed transducer signals to be generated by the light-sensitive element. The multiplexed transducer signals are synchronously de-multiplexed into two discrete transducer signals which are phase shifted using a phase shifting network, and then summed in the time domain to produce a pickup signal.

DETAILED DESCRIPTION OF THE PREFERRED EMBODIMENTS

Figure 1:
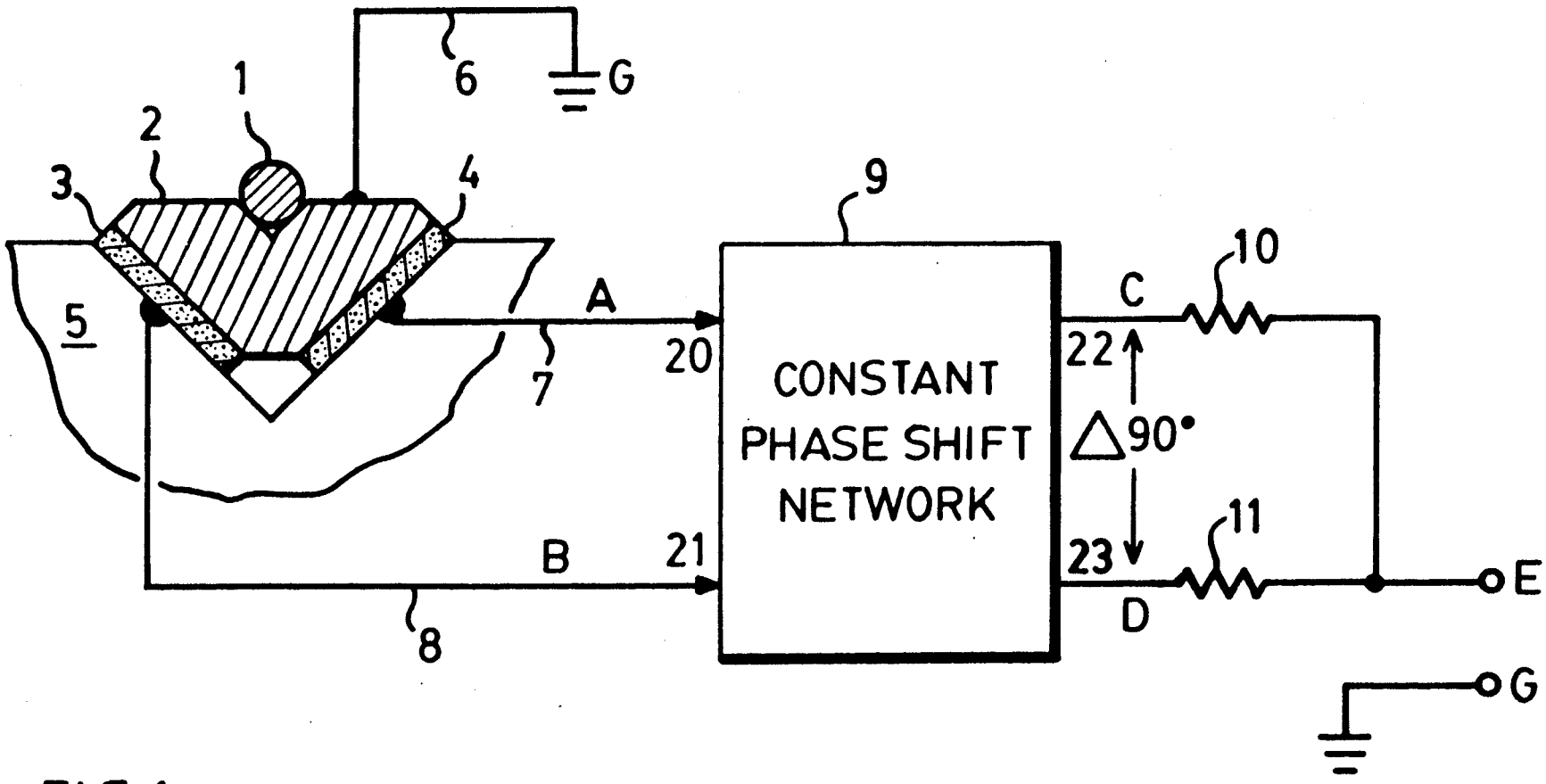
FIG. 1 is a diagram of a first embodiment of a pickup according to the present invention which includes an elevation view of a portion of the bridge of a guitar supporting a mechanico-electrical transducer assembly.

Referring now to FIG. 1 of the drawings, a pickup according to the present invention comprises a string receiving element 2 which transmits the vibrations of a vibrating string 1 to a pair of underlying pressure transducer elements 3 and 4, responsive in the tickness mode and having approximately equal sensitivity. The pressure transducer elements 3 and 4 are supported by a hard and massive bridge 5 of a guitar. The pressure transducer elements 3 and 4 are positioned and oriented with respect to the vibrating string 1 so as to be maximally responsive in orthogonal planes of string vibration. Pressure transducer element 4 which produces signal A is connected through a conductor 7 to a first input 20 of a constant phase shift network 9. Pressure transducer element 3 which produces signal B is connected through a conductor 8 to the second input 21 of the constant phase shift network 9. Electrically conductive string receiving element 2 is grounded through a conductor 6 in order to provide a ground connection G to each of the pressure transducer elements 3 and 4 and thus allow the transducer signals A and B to be ground referenced as it is normally the case.

The constant phase shift network 9 dephases the transducer signals A and B and produces the corresponding separate phase shifted signals C and D which are dephased with respect to each other by approximately 90 degrees over a wide range of frequencies. Signal A is dephased into signal C and signal B is correspondingly dephased into signal D. Signals C and D appearing at the outputs 22 and 23 of the constant phase shift network 9 are combined by passing them through equal value summing resistors 10 and 11 which are connected together to produce a joint signal E. The joint signal E is a ground G referenced pickup signal.

Figure 2:
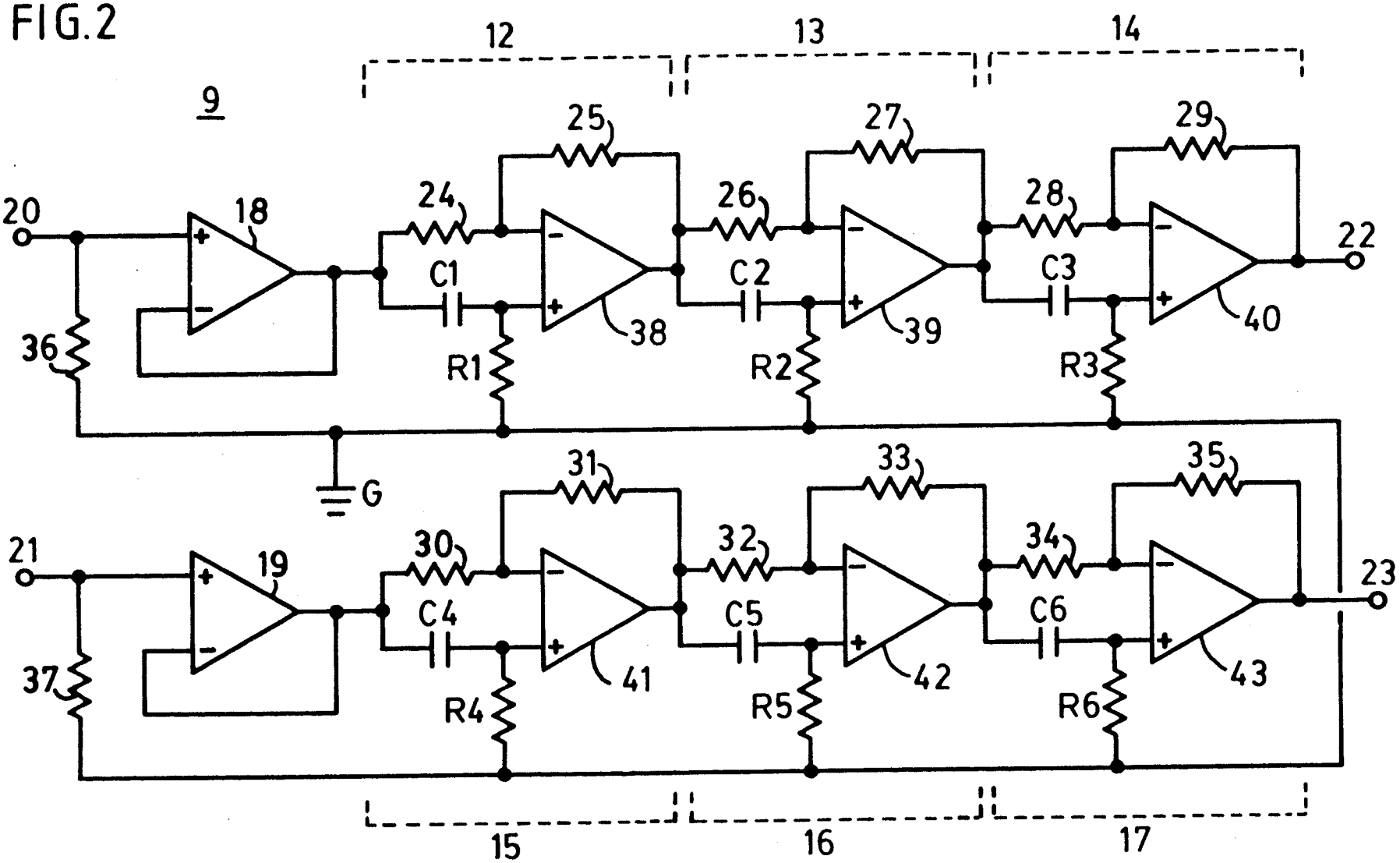
FIG. 2 is an electrical diagram of the constant phase shift network used in the embodiment of FIG. 1.

FIG. 2 illustrates the elements composing the constant phase shift network 9 of the embodiment of FIG. 1. The constant phase shift network 9 is formed of two separate circuit branches of similar construction and which have a flat frequency response, but which dephase the signals passing through them by different amounts. In a first circuit branch, a first input 20 of the network 9 is connected to a buffer amplifier 18 which is followed by a first group of all-pass filters 12, 13 and 14, the output of all-pass filter 14 being the first output 22 of the constant phase shift network 9. In a second circuit branch, a second input 21 of the constant phase shift network 9 is connected to a buffer amplifier 19 which is followed by a second group of all-pass filters 15, 16 and 17, the output of all-pass filter 17 being the second output 23 of the constant phase shift network 9. The turnover frequencies of the all-pass filters 12–17 are such that a 90 degree phase shift is created over a wide range of frequencies between the outputs 22 and 23 of the constant phase shift network 9. Capacitors C1–C6 are equal value components and they are given a nominal value of 0.0033 microfarad. A set of values for R1–R6 along with the corresponding turnover frequencies of the all-pass filters 12–17 of the network 9 are given in Table 1. Resistors 24–35 are all equal value components and are given an arbitrary value of 10K ohms. Resistors 36 and 37 are input biasing resistors and they are given an arbitrary value of 10M ohms. The operational amplifiers 38–43 used in the all-pass filters 12–17 are of conventional design, having high gain, high input impedance and low output impedance, and they may be any of the commonly available types such as 741, 5534 or Tl071. Such all-pass filters and their arrangement to produce constant phase shift networks are well known to those skilled in the art of filter design and need not be discussed in further depth.

TABLE 1

| 90° ± 1° phase shift between 100Hz and 1000Hz 6 all-pass stages C1–C6 = .0033 uF | | |
|---|---|---|
| R1 | 16.2K | 2977Hz |
| R2 | 118K | 408.5Hz |
| R3 | 511K | 94.38Hz |
| R4 | 54.9K | 878.5Hz |
| R5 | 237K | 203.0Hz |
| R6 | 1.74M | 27.72Hz |

Other means to dephase the transducer signals A and B such as phase transformers, time delay devices, etc. may be used in the present invention which requires that a phase shift exist between the transducer signals A and B, minimally at one frequency of string vibration, this frequency being preferably the fundamental frequency of vibration of the string 1.

The presence of any effective amount of phase shift other than 0 degree, 180 degrees or any integer multiple thereof between the transducer signals A and B will reduce the additive and substractive tendencies of their common components by a certain amount, and thus will enable the pickup to respond in all planes of vibration of the string 1 by preventing the creation of a plane of zero joint signal response. As the effective amount of phase shift between the transducer signals A and B approaches some optimal value, the additive and substractive tendencies of the transducer signals A and B are virtually eliminated.

Figure 3:
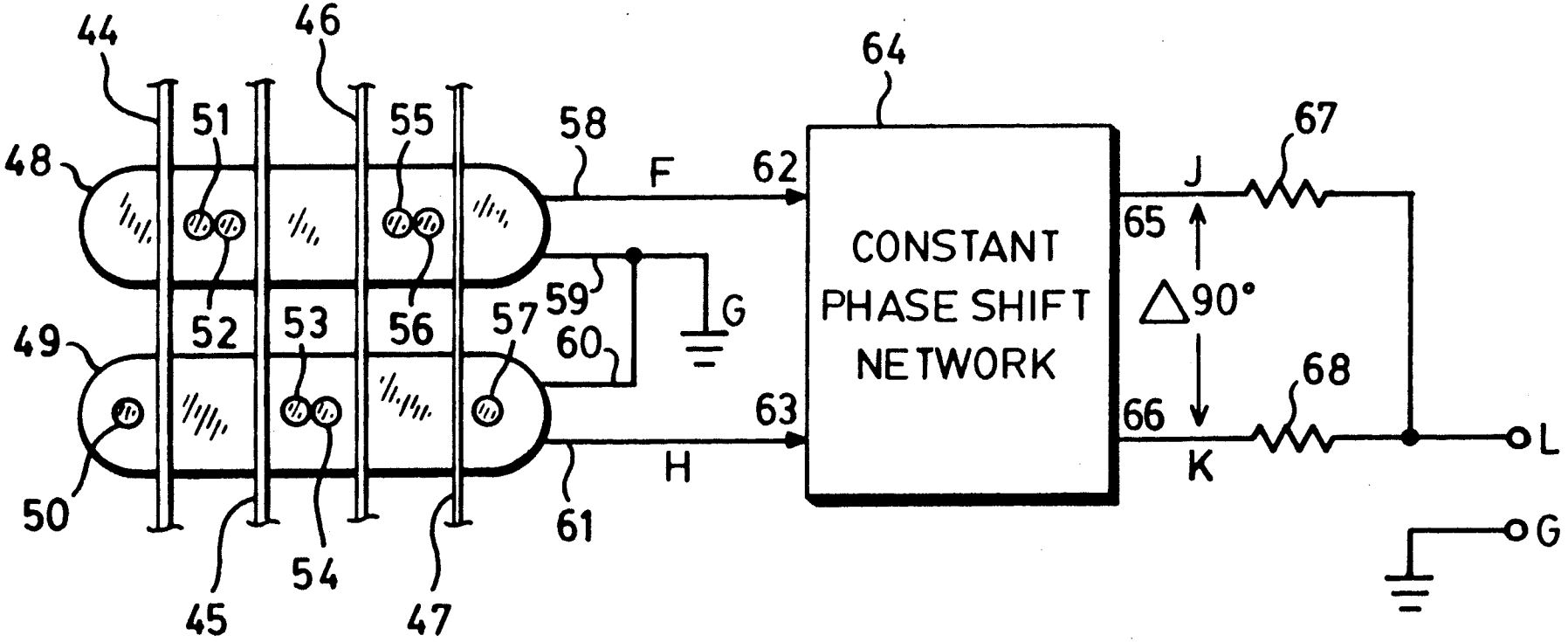
FIG. 3 is a diagram of a second embodiment of a pickup according to the present invention which includes a top view of a pair of electromagnetic transducers located under the strings of a bass guitar.

FIG. 3 illustrates one embodiment of a magnetic pickup according to the present invention. The pickup is composed of a pair of electromagnetic transducers 48 and 49 positioned in the usual beneath the ferrous strings 44–47 of a bass guitar. Electromagnetic transducers 48 and 49 have magnetic polepieces 50–57 located near the strings 44–47. Polepiece 50 of transducer 49 is positioned on one side of string 44 while polepiece 51 of transducer 48 is positioned on the other side of string 44; the other polepieces 52–57 of transducers 48 and 49 are likewise positioned with respect to strings 45–47. It can be seen that each string 44–47 vibrates in the vicinity of a pair of polepieces 50–57 located in different electromagnetic transducers 48 and 49. In this manner, the electromagnetic transducers 48 and 49 are maximally responsive in different planes of vibration of the strings 44–47. Electromagnetic transducers 48 which produces signal F is connected through a conductor 58 to a first input 62 of a constant phase shift network 64 similar to that FIGS. 1 and 2. Electromagnetic transducer 49 which produces signal H is connected through a conductor 61 to a second input 63 of the constant phase shift network 64. When more than one string 44–47 is vibrating, transducer signals F and H are composite string signals. The electromagnetic transducers 48 and 49 are grounded respectively through conductors 59 and 60 in order to allow the transducer signals F and H to be ground referenced in the usual manner. The transducer signals F and H are dephased, in a manner similar to that described in the embodiment of FIG. 1, by a constant phase shift network 64. Signals J and K appearing at the outputs 65 and 66 of the constant phase shift network 64 are phase shifted with respect to each other by about 90 degrees over a wide range of frequencies. The dephased transducer signals J and K are then combined through equal value summing resistors 67 and 68 which are connected together to produce a joint signal L. Signal L is a ground referenced pickup signal.

Figure 4:
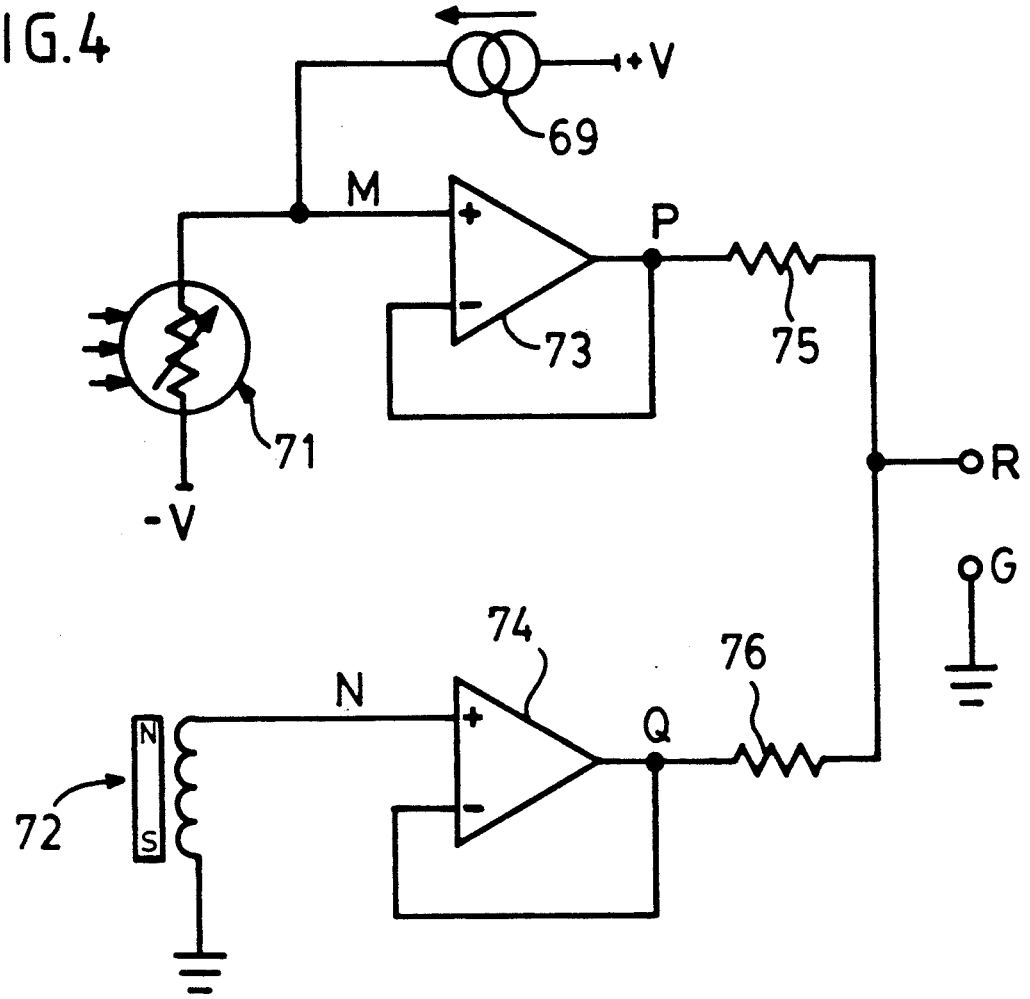
FIG. 4 is a diagram of a third embodiment of a pickup according to the present invention which uses a piezoresistive pressure transducer and an electromagnetic proximity-gradient transducer.

In FIG. 4, a pickup according to the present invention comprises a piezoresistive pressure transducer element 71 biased by a constant current source 69, and an electromagnetic proximity transducer 72 of conventional design. The pressure transducer 71 which produces transducer signal M is buffered using a first voltage follower amplifier 73 which produces buffered transducer signal P. The electromagnetic transducer 72 which produces transducer signal N is buffered by a second voltage follower amplifier 74 which produces buffered transducer signal Q. A phase difference or phase shift exists between the transducer signals M and N by virtue of the different manner in which each transducer 71 and 72 monitors the vibrations of an associated string 70. The pressure transducer 71 effectively monitors the position of the string 70 since the transducer signal M, caused by the forces exerted on the pressure transducer 71 by the string 70, is effectively in phase with the instantaneous position of the string 70. The electromagnetic transducer, on the other hand, responds to the instantaneous velocity of a monitored segment of the string 70. Since the velocity of the monitored segment of the string 70 reaches a minimum instantaneous value when its displacement reaches a maximum instantaneous value, it can be realized that the signal N from the electromagnetic transducer 72 is naturally dephased with respect to the signal M from the pressure transducer 71.

Any suitable signal dephasing means may be used if it is found desirable to dephase the transducer signals M and N any further with respect to each other in order to improve the planar response of the pickup. If the transducers 71 and 72 have different sensitivities to the string vibrations or if they have a different frequency response with respect to each other, either or both transducers 71 and/or 72 may be equalized to compensate for such response differences. Depending on the device or network producing it, such equalization can be made to introduce a desirable amount of phase shift between the transducer signals M and N or between the buffered transducer signals P and Q. The buffered transducer signals P and Q are combined using a pair of summing resistors 75 and 76 which are connected together to produce a joint signal R. The joint signal R is the pickup signal.

Figure 5:
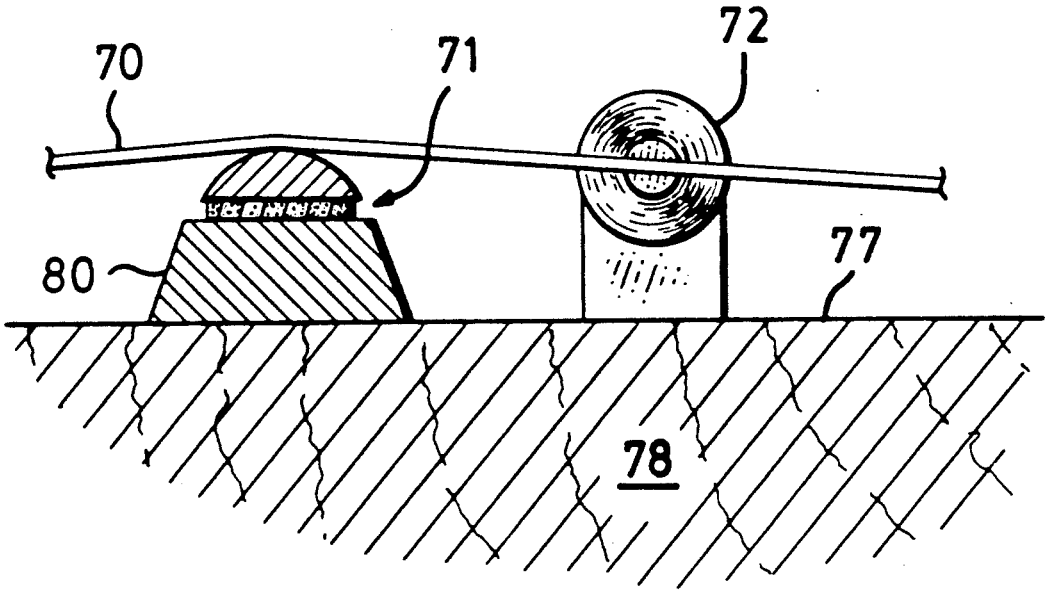
FIG. 5 is a side view of an instrument string showing the relative position of the transducers used in the embodiment of FIG. 4.

FIG. 5 shows the physical arrangement of the transducers 71 and 72 of the embodiment of FIG. 4 in a side view where the horizontal plane is defined as being generally parallel to the top surface 77 of the body 78 of the instrument. The pressure transducer 71 is located on the bridge 80 of the instrument and serves to define one end of the vibating portion of the string 70 where it is maximally responsive to string vibrations occurring in the vertical plane. The electromagnetic transducer 72 is located near the string 70, at a distance from the pressure transducer 71, where it is positioned and oriented with respect to the string 70 so as to be maximally responsive to vibrations of the string 70 occuring in the horizontal plane. The electrical connections from the transducers 71 and 72 have been omitted for clarity.

Figure 6:
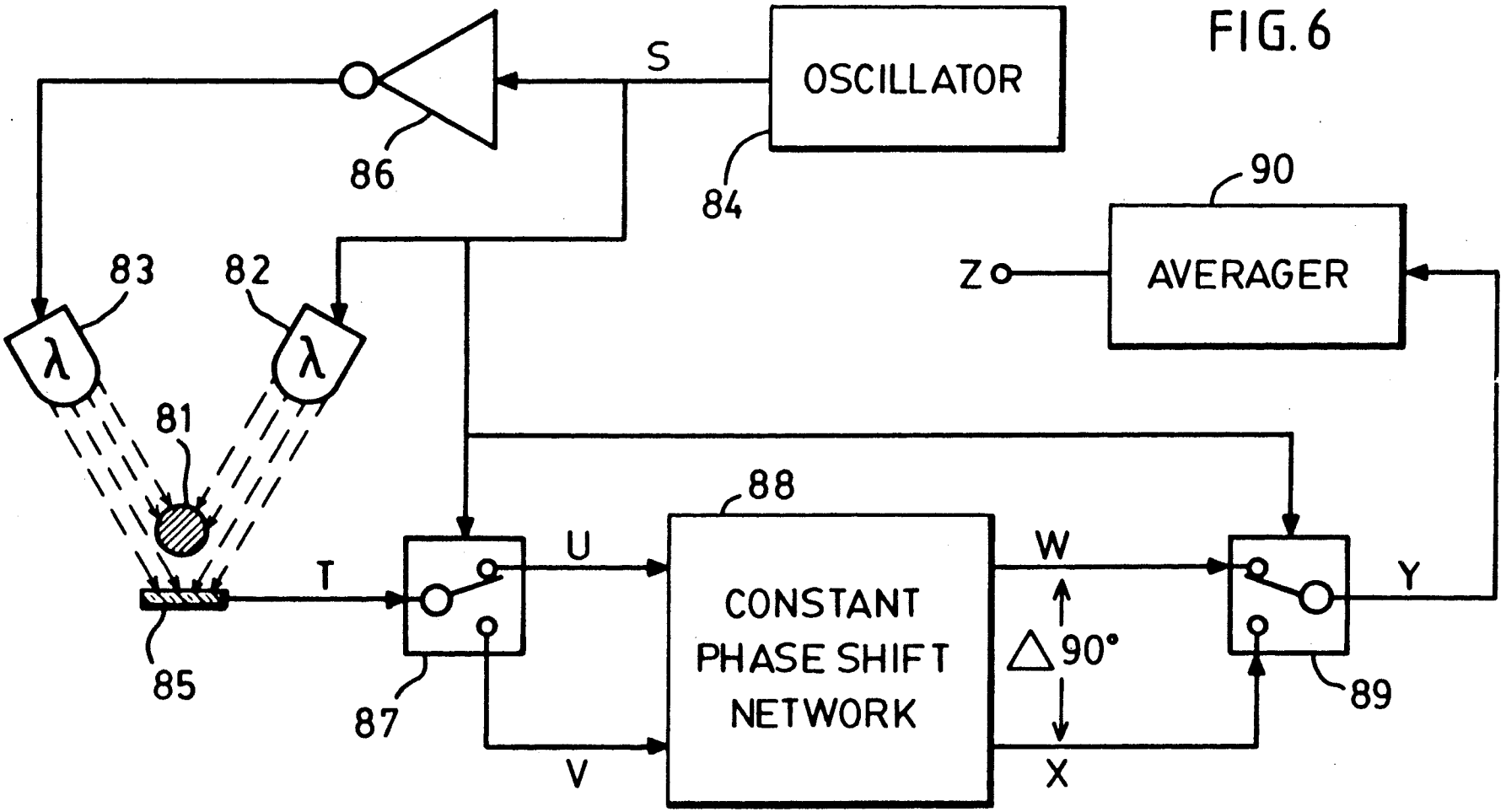
FIG. 6 is a diagram of a fourth embodiment of a pickup according to the present invention which illustrates the positional relationships between a vibrating string, a light-sensitive element and a pair of light sources.

In FIG. 6, a pickup according to the present invention is composed of a light sensitive element 85 located near a vibrating string 81 seen in cross-section, and of a pair of directional light sources 82 and 83 which are alternately powered at a fast rate. A high frequency oscillator 84 producing a square wave signal S having a pulse width of approximately 50% is used to drive the first light source 82. The square wave signal S from the oscillator 84 is also used to drive an inverter 86 which powers the second light source 83. The light sources 82 and 83 are positioned and oriented with respect to the string 81 and with respect to the light sensitive element 85 in such a manner that the light sensitive element 85 is maximally responsive in a first plane of string 81 vibration when the first light source 82 is powered, and maximally responsive in a second plane of string 81 vibration when the second light source 83 is powered. Since the light sources 82 and 83 are alternately powered at a fast rate, the resulting signal T from the light sensitive element 85 is a composite or "multiplexed" signal T which actually contains successively alternating increments of two distinct transducer signals U and V. This is possible because the first light source 82 and the light sensitive element 85 effectively form a first transducer during a first half cycle of the square wave S from the oscillator 84, after which the second light source 83 and the light sensitive element 85 effectively form a second transducer during the second half-cycle of the square wave S, and so on in an alternating manner for as long as the operation of the oscillator 84 is maintained.

The composite transducer signal T from the light sensitive element 85 is de-multiplexed using a synchronous electronic toggle switch 87 driven by the oscillator 84. The switch 87 produces two separate transducer signals U and V which are dephased using a phase shift network 88 of the type generally described in FIG. 2 and which produces the corresponding dephased transducer signals W and X. The dephased transducer signals W and X are re-multiplexed into a composite dephased transducer signal Y using a second synchronous electronic toggle switch 89 also driven by the oscillator 84. The composite signal Y is averaged using an averaging network 90 which effectively sums the successive increments of the multiplexed signals W and X contained therein, in the time domain. The averaging network 90 produces an averaged signal Z. The averaging network 90 may consist solely of a capacitive shunt of small reactance value if the resistance of the switch 89 is significant. The averaged signal Z is the pickup signal.

Still other variations will suggest themselves to persons of ordinary skill in the art. For example, other types of transducers may be used together or in combinations other than those described; the transducer signals may be transmitted, stored, circulated, transposed or otherwise acted upon to create a phase shift for the purpose of the present invention without departing from its true scope and spirit. It is intended therefore that the foregoing description be considered as exemplary only and that the scope of the present invention be ascertained by the following claims.

What is claimed is:

1. A pickup for detecting planar vibrations of a vibrating element of a musical instrument, comprising:

first transducer means maximally responsive in a first plane of vibration of said vibrating element for producing a first transducer signal, second transducer means maximally responsive in a second plane of vibration of said vibrating element different from said first plane of vibration, for producing a second transducer signal, means to phase shift said first and second transducer signal thereby creating a phase shift between said first and said second transducer signal wherein a sensitivity in a third plane of vibration of said vibrating element is increased, and a means to combine said phase shifted said first and said second transducer signals and produce a joint transducer signal therefrom, whereby said pickup is simultaneously responsive to all of said planar vibrations of said vibrating element.

2. The pickup of claim 1 wherein (a) said first plane of vibration is approximately perpendicular to (a) said second plane of vibration.

3. The pickup of claim 1 wherein a single transducer element common to said first and to said second transducer means produces a composite transducer signal composed of successive increments of said first and of said second transducer signals.

4. The pickup of claim 1 wherein said phase shift produced between said first and said second transducer signals has a magnitude which is effectively equal to approximately 90 degrees.

5. The pickup of claim 1 wherein (a) said phase shift is (created minimally at one frequency) produced at a plurality of frequencies of said vibration of said vibrating element.

6. The pickup of claim 1 wherein (a) said phase shift is (created minimally at the) produced at a fundamental frequency of vibration of said vibrating element.

7. The pickup of claim 1 wherein a said transducer means includes a part of said means to produce said phase shift.

8. The pickup of claim 1 wherein (at least a part of) said means to (create) produce a said phase shift is comprised of a position-sensing said first transducer means (effectively responsive to the position of said vibrating element) and a velocity-sensing said second transducer means (effectively responsive to the velocity of said vibrating element).

9. The pickup of claim (1) 8 wherein (the magnitude of) said first transducer signal has a magnitude which is effectively (indicative of the instantaneous) proportional to a displacement of said vibrating element in (a first) said first plane of vibration, and wherein (the magnitude of) said second transducer signal has a magnitude which is effectively (indicative of the instantaneous) proportional to a velocity of said vibrating element in (a) said second plane of vibration.

* * * * *